United States Patent [19]

Houser

[11] Patent Number: 5,060,731

[45] Date of Patent: Oct. 29, 1991

[54] METHOD OF INSTALLING WELL CONDUCTORS

[75] Inventor: Daniel M. Houser, Thibodaux, La.

[73] Assignee: McDermott International, Inc., New Orleans, La.

[21] Appl. No.: 658,829

[22] Filed: Feb. 22, 1991

[51] Int. Cl.[5] ..... E21B 7/12

[52] U.S. Cl. ..... 166/350; 166/379; 175/5; 405/171

[58] Field of Search ..... 166/350, 376, 380, 192, 166/379, 378; 405/171, 162, 205, 200; 175/7, 5

[56] References Cited

U.S. PATENT DOCUMENTS

| | | | |
|---|---|---|---|
| 3,670,507 | 6/1972 | Mott et al. | 175/7 X |
| 3,754,607 | 8/1973 | Van Daalen | 175/7 |
| 3,782,460 | 1/1974 | Skinner | 166/350 X |
| 4,142,371 | 3/1979 | Mayfield et al. | 405/224 |
| 4,184,515 | 1/1980 | Streich et al. | 166/192 X |
| 4,262,702 | 4/1981 | Streich | 166/192 X |
| 4,286,629 | 9/1981 | Streich et al. | 166/192 X |
| 4,474,509 | 10/1984 | Antes et al. | 405/205 X |
| 4,804,018 | 2/1989 | Carr et al. | 405/205 X |

*Primary Examiner*—Hoang C. Dang

*Attorney, Agent, or Firm*—Robert J. Edwards; Michael L. Hoelter

[57] ABSTRACT

This invention pertains to a method of installing well conductors in such a way that the load upon the platform is significantly reduced thereby also eliminating the need for additional framing members. In accordance with this method, an end region of a well conductor is plugged which, if the conductor has a diameter-to-wall thickness ratio of about thirty to one (30:1), will cause the conductor to achieve nearly neutral buoyancy. By selectively adjusting the buoyancy of the conductor, such as by flooding or de-ballasting, additional conductor lengths may be added without imposing an unduly large load upon the platform. In this fashion, a smaller crane will be able to lower the conductor string without the need for a much larger derrick crane, which may then be more efficiently used solely to upend and stab the elongated conductors through the platform.

15 Claims, 3 Drawing Sheets

METHOD OF INSTALLING WELL CONDUCTORS

FIELD OF THE INVENTION

This invention pertains to well conductors associated with offshore platforms and more particularly, to the use of flotation plugs in such conductors during their installation.

BACKGROUND OF THE INVENTION

In an offshore environment, well conductors are installed soon after the platform is secured in place so as to provide support for subsequent well casings or other drilling equipment which are inserted therethrough. Well conductors are normally large tubes having a diameter of about 20 inches or more and when installing these conductors, generally one of the following methods is used.

The first method (which has lost favor in the industry due to recent improvements in equipment) involves the welding of stops or padeyes to the outer surface of each conductor. These stops bear on framing members (which may be either permanent or temporary) that are designed to support the entire conductor string hanging from the top of the platform until the string becomes self-supporting. Consequently, the number of conductor strings which can be worked simultaneously is limited by the strength of these framing members and the overall ability of the platform to resist such loading.

During installation and as additional conductor lengths are needed, a crane is used to lift each individual conductor length from a supply barge, upend it, and vertically stab it in place. Afterwards, when the new length is securely added to the string, the crane lifts the entire string (a feat in itself!) so that the lower stops can be removed in order to lower the string the length of the new member. Stops secured to the upper end of the new member would then engage the framing members and the whole process would start over again. As can be imagined, this method is very slow and time consuming, it being costly in terms of labor, needed crane capacity, and crane time since the same crane that upends the new length must also lift the entire string, a separate smaller crane is unable to handle either procedure. The cost of fabricating stops and the cost associated with removing stops is often significant.

An improvement to this method involves specialized external and internal grippers that grab and hold the conductors in lieu of the aforementioned stops and/or padeyes. The internal gripper is generally secured to the crane while the external gripper is generally secured to the platform. In this fashion, the crane uses the internal gripper to hoist the conductor length and position it onto the conductor string for subsequent welding. The external gripper, which supports the string during this operation, is deactivated only when it is desired to allow the new conductor length to slide through it (the crane supporting the entire conductor string during this operation). While this method is quicker in that there is no need to continuously add and then remove stops and/or padeyes, it still requires the addition of framing members to the platform so as to support the string until it becomes self-supporting and it still requires a very large crane for both upending the new member and for lowering the entire conductor string.

In order to reduce the needed crane time, a system has been developed utilizing two external grippers, one being movable with respect to the other by a series of jacks. With this system, a large crane and the internal gripper or padeyes and slings would still be used to lift the new conductor length and align it with the string for welding as before. Afterwards, however, one external gripper (which is in a raised position) would be lowered by the jacks toward the other external gripper, this lower gripper being deactivated so as to allow the string to slip through it. In this fashion, the entire conductor string is always supported by one or both of the external grippers and not by the crane. While this method eliminates the need for large crane tonnage, it is a very slow process due to the leisurely pace and small stroke of the jacks. Additionally, framing members are still needed and the platform itself must still be designed so as to withstand the temporary imposition of large installation loads.

It is thus an object of this invention to provide a method of installing conductors in an offshore environment that reduces the need for large crane tonnages. Another object of this invention is to provide a method that substantially eliminates the need for additional framing members. Still another object of the invention is to provide a method that reduces the installation or construction loading on the platform thereby permitting a more efficient and lighter structure to be built. A further object of this invention is to provide a method of installing well conductors that is faster and easier to accomplish than the methods now known. These and other objects will become obvious upon further investigation.

SUMMARY OF THE INVENTION

This invention pertains to a method of installing a well conductor in a marine environment comprising the step of plugging an end region of a conductor so that it will achieve the desired degree of buoyancy when submerged. Afterwards, additional conductor lengths are affixed to this first conductor and also submerged. Additional buoyancy or ballasting of the conductor string is provided as needed so as to control the rate of sinking and to limit the load applied to the platform. Upon achieving self-support, the plugs of the conductor string are either removed or left in place until completion of driving and later drilled in preparation for the insertion of well casing or other drilling equipment.

DETAILED DESCRIPTION OF THE DRAWINGS

Figure 1:
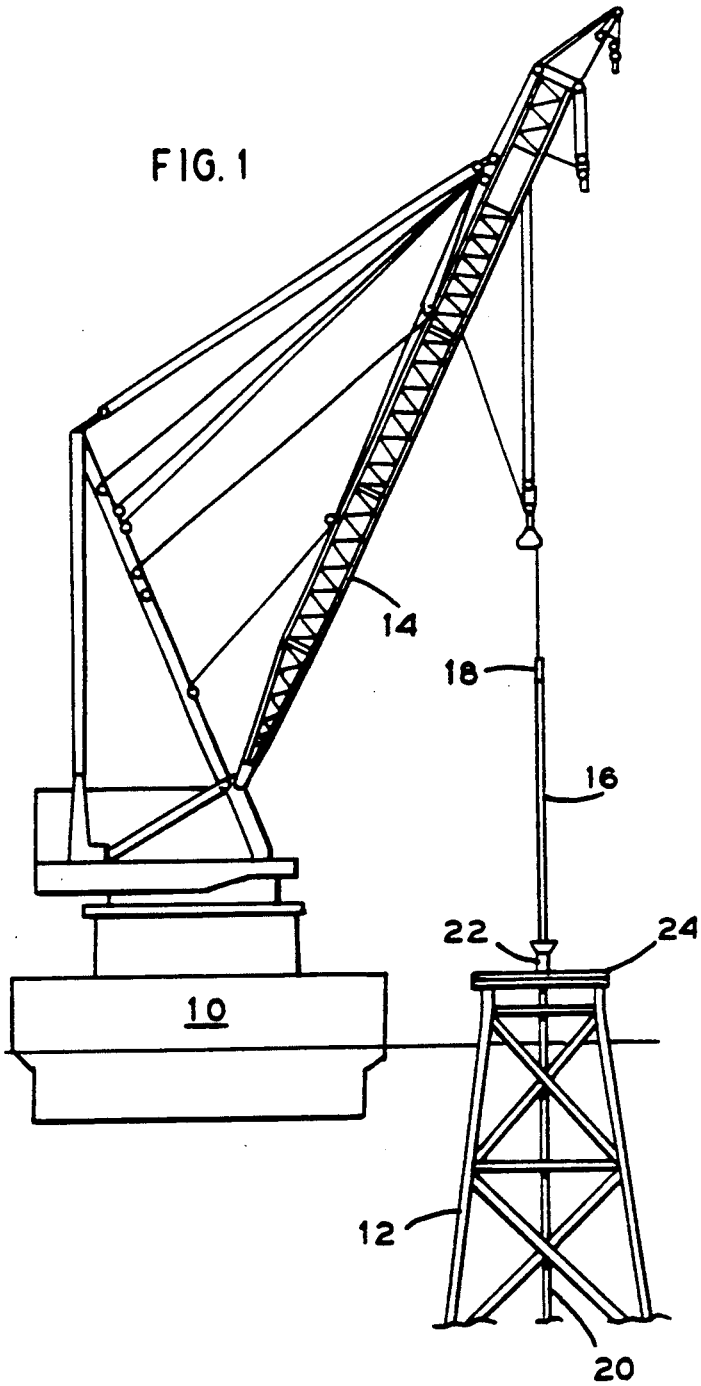
FIG. 1 is a front pictorial view of a conventional method of installing a conductor in a marine environment.
Figure 2:
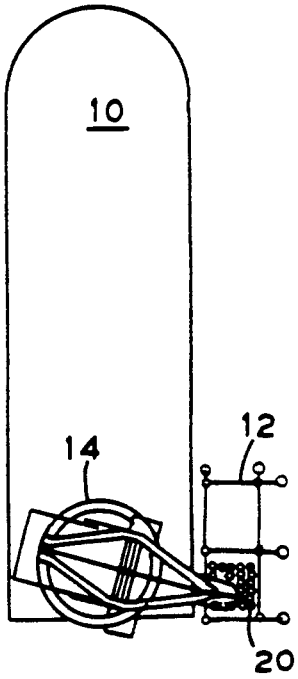
FIG. 2 is a plan pictorial view of the method disclosed in FIG. 1.

Referring initially to FIGS. 1 and 2, there is shown a conventional method of installing a conductor in a marine environment. In accordance with this method, derrick or supply barge 10 is anchored or otherwise positioned alongside platform 12 prior to conductor installation. Because of the long lengths of the conductors involved (anywhere from 50 to over 200 feet is normal), derrick crane 14 on derrick barge 10 is used to uplift and stab each conductor 16 within its guides on platform 12. Generally, an internal gripper 18 is used by derrick crane 14 to lift conductor 16 off supply barge 10 and position it as needed. Once conductor 16 is properly installed and secured to the top of conductor string 20, derrick crane 14 lowers string 20 until the addition of another conductor 16 is required. Alternatively, a series of external grippers 22 on jacks could support conductor string 20 rather than crane 14. However, crane 14 will still be needed to lift and stab conductors 16 as shown and also may be needed to balance and stabilize conductors 16. This, unfortunately, ties up crane 14 and while being used in this fashion, it is being vastly underutilized.

In any event, due to the heavy weight of each conductor 16 (typically ranging from 5 to 30 tons each, depending on length), it does not take very many conductor lengths to amount to a sizable load upon platform 12, especially in view of the fact that such platforms are sometimes a thousand feet or so above the ocean bottom. Consequently, it becomes necessary to install additional framing members 24 on platform 12 to withstand such loading and to transfer this loading to the legs of platform 12. This additional construction or installation loading will occur until conductor string 20 becomes self-supporting. The weight of conductor string 20 normally dictates the use of large cranage or sophisticated jacking equipment to lower string 20.

Furthermore, there is often thirty or so conductor strings 20 installed on a single platform (see FIG. 2), but, by necessity, they are installed one or only a few at a time. This thus makes it important to develop a quick and reliable method of installing each conductor string 20 so as to save both time and money. Obviously, the size of the group of conductors 16 which can be installed simultaneously and the amount of time required to install each conductor string is dependant upon the installation pace.

Figure 3:
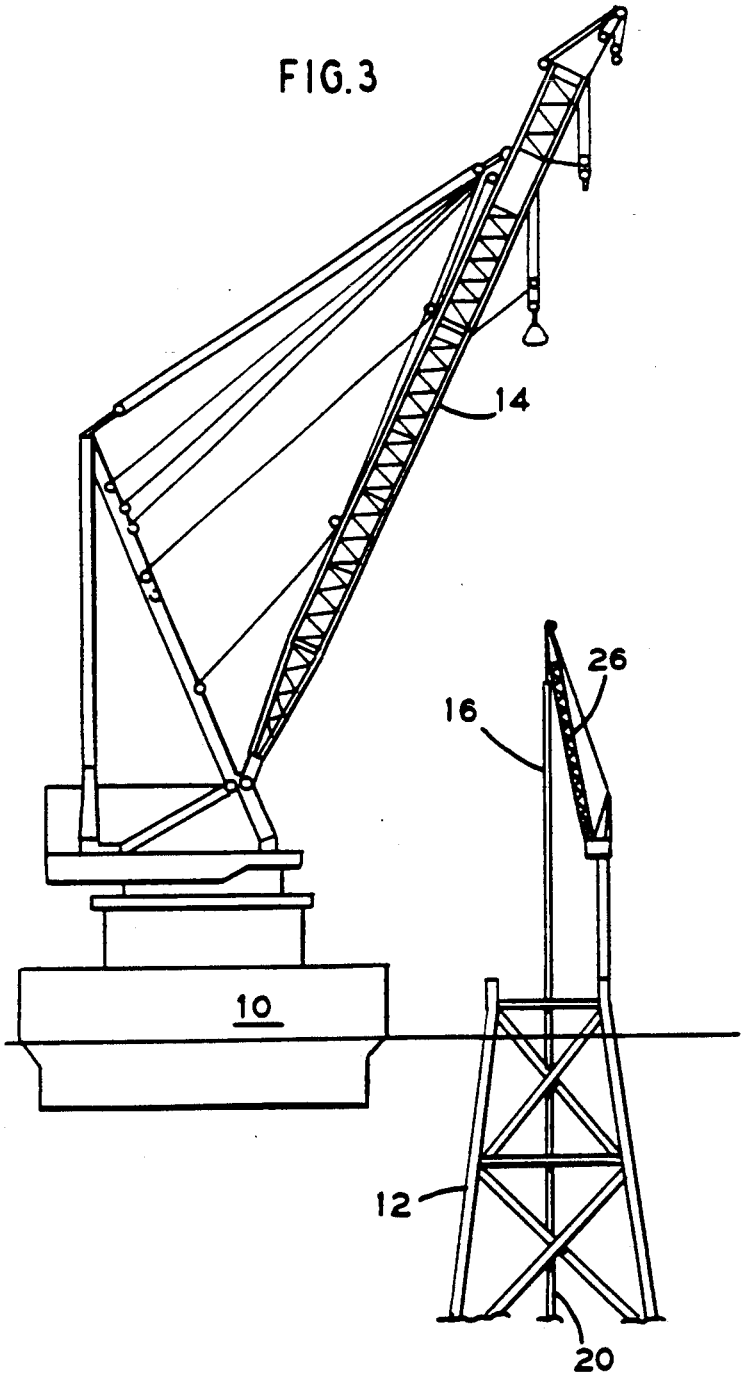
FIG. 3 is a front pictorial view of the inventor's method of installing a conductor in a marine environment.
Figure 4:
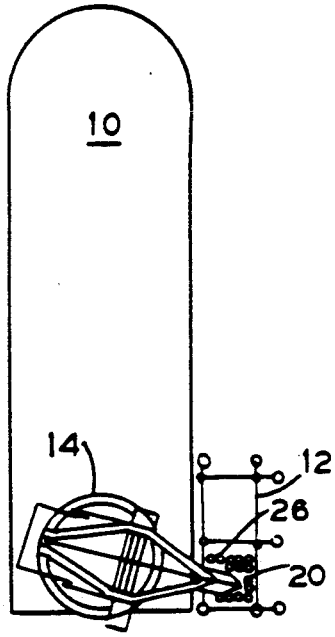
FIG. 4 is a plan pictorial view of the inventor's method of installation.
Figure 5:
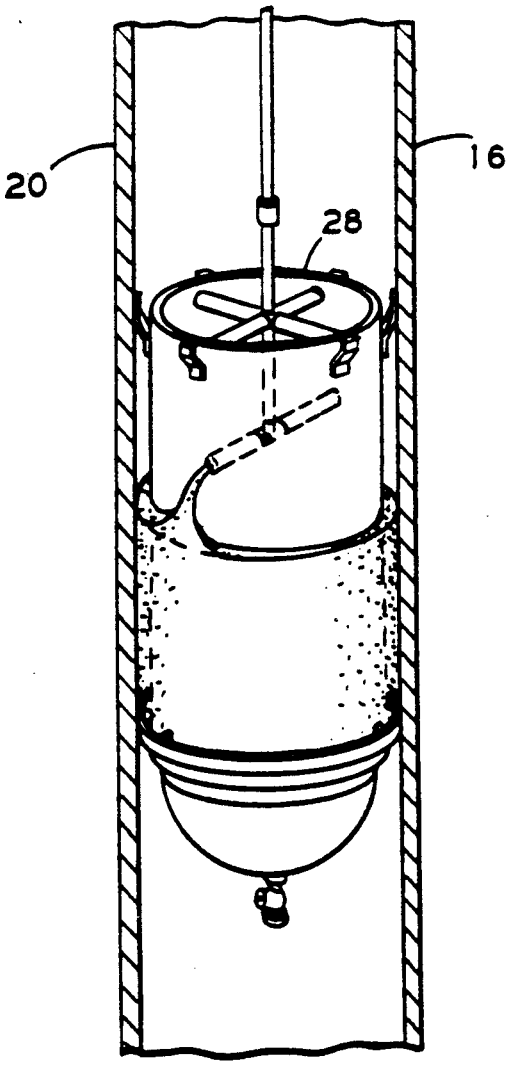
FIG. 5 is a pictorial view, partially broken away, of a typical conductor plug used in conjunction with the inventor's method.

Referring now to FIGS. 3, 4, and 5, there is shown the inventor's method and apparatus of installing conductors 16 in a marine environment. As immediately apparent, an additional crane, crane 26, is employed so as to free derrick crane 14 from tasks which cause it to be underutilized. This additional crane 26 may be a platform mounted crane or it may be another crane on barge 10. In any event, by utilizing the present method the conductor string loading is significantly reduced thereby enabling smaller crane 26 to lower conductor string 20 to the seafloor. Consequently, there is often no or only a slight increase in expense associated with using crane 26, or other suitable cranage, during conductor installation. However, this added expense is quickly recouped by the reduced need for larger derrick crane 14.

Additionally, conductor plug 28 (FIG. 5) is employed within one or more conductors 16 of conductor string 20. Plug 28 seals an end of conductor 16 thereby making it watertight and should its strength and diameter to wall thickness ratio be in the proper range, conductor 16 may actually achieve a positive buoyancy when submerged without collapsing. The strategic placement of plug 28 will greatly reduce the loading upon platform 12 by effectively eliminating the excessive weight of string 20. Should additional ballast be needed to submerge string 20, water can be allowed to enter string 20 thereby weighing it down so that is will sink rather than float. Thus, by adjusting the water level in conductor string 20, the desired buoyancy can be achieved.

A direct result of the buoyancy provided for string 20 is the elimination of the need for additional or strengthened framing members 24 to support string 20 during installation. Additionally, because the construction load upon platform 12 is significantly reduced, platform 12 may be designed without taking these excessive forces into consideration (i.e. a lighter structure will result). Also, smaller stops or padeyes can be used since the forces on these devices are significantly reduced. The same can be said for external grippers 22 if they are used since they now need only support a load that is a fraction of what they normally were required to support.

FIG. 5 discloses a typical plug 28, it is described in more detail in U.S. Pat. No. 4,804,018 issued to Carr et al. Alternate designs are also usable such as a modification of those manufactured by Davis-Lynch Inc. or others in this field. Furthermore, the use of grout, cement polymer materials, rubber based materials or inflatable bladders are equally suitable since after drilling, the interior of conductor 16 must be free of permanent obstructions. About the only requirement is that plug 28 be water-tight to the point of self-support and that it be drillable after string 20 is installed or removable prior to the driving of well casings. It is also important that plug 28 be capable of being installed at a variety of locations along string 20 so as to prevent or control the flooding of string 20.

As mentioned earlier, a sealed steel tubular member achieves neutral or positive buoyancy when the ratio of the outside diameter to wall thickness is approximately thirty to one (30:1). This parameter is oftentimes referred to as the D/t ratio. Sealed tubulars with a D/t ratio greater than approximately 30:1 will float while those with a D/t ratio less than approximately 30:1 will sink in water. The actual numerator of the neutral point ratio will vary according to the density of the fluid medium in which the tubular is immersed. However, regardless of the D/t ratio, the sealing or plugging of conductor string 20 to prevent flooding will reduce the negative bouyancy of conductor string 20 due to the displacement of water and thus reduce its weight and associated load upon crane 26.

Consequently, by installing plug 28 or a temporary seal inside conductor string 20 either at the bottom end of string 20, or at predetermined locations, the effective weight of string 20 can be significantly reduced. This will achieve the benefits referred to above by reducing the load on platform 12. Also, by incorporating one or more supplemental cranes, derrick crane 14 can be used solely to lift and stab additional conductors 16 in place (where the height provided by such crane is needed) while the smaller crane or cranes 26 can be used for balancing and stabilizing the stabbed conductor 16. Thus, the installation procedure will be quickened and the time required to install each of the thirty or so conductor strings 20 will be greatly reduced.

An added benefit of the reduced load of string 20 is the fact that larger batches of conductors can now be hung (i.e. pre-assembled lengths of conductors) so as to speed the installation process even further.

The method of this invention is as follows. Plug 28 is installed in the typical fashion within either the lowest conductor 16 or at some other location depending upon the amount of positive buoyancy desired. In the alternative, conductor 16 could already be submerged before plug 28 is installed, but this may require the additional step of de-ballasting the submerged conductor 16 after plug 28 is set. Despite the manner in which plug 28 is installed, conductor string 20 is lowered by gravity either by means of smaller crane 26 (which can handle such smaller loads) or by a series of external grippers supported on jacks (not shown in FIG. 3). Should the positive buoyancy of string 20 become too great, it can be flooded so that string 20 once again can be lowered under its own weight. In this fashion, derrick crane 14 is used solely to upend and stab the individual conductor lengths 16 in place. Because of the great height of derrick crane 14, it may be possible for two or more such conductor lengths to be combined on supply barge 10 before being upended. This will cut in half the already reduced amount of time required to install each conductor string 20.

It is also possible for two or more conductor strings 20 to be installed simultaneously. In accordance with this procedure, while derrick crane 14 is upending and stabbing with respect to one conductor string 20, platform crane 26 is lowering the other conductor string 20. Thus, when the stabbing operation is completed, it is also likely that the lowering operation is likewise completed so that derrick crane 14 can now upend a conductor length 16 for the string just lowered while platform crane 26 lowers the string 20 that has just been stabbed. It is also plausible for three or more strings 20 to be installed simultaneously the procedure would be similar to that just described.

Once string 20 has achieved self-support by either self-penetration or by being driven, both cranes 14 and 26 become free to initiate the installation procedure with another conductor string 20. It also becomes possible to remove or drill out plug 28 as needed since platform 12 will not be incurring any significant additional load.

In the event only small conductor lengths 16 are used, it becomes possible for the smaller platform crane 26 to perform the conductor installation without the need for the much larger derrick crane 14. Using only the smaller platform crane 26, however, will increase the amount of time needed to install the various conductor strings 20, but, the cost of such installation will be drastically reduced since the expense of derrick crane 14 will not be incurred.

After the conductor strings 20 are installed and plugs 28 drilled out or removed, casings or wells may be inserted through the string for future undersea development.

One benefit of choosing to plug the bottom end of conductor 16 and driving conductor string 20 to the desired penetration depth below the seabed (or refusal if penetration cannot be achieved) is that drilling survey tools can then be deployed immediately inside conductor string 20 to establish its bearing and inclination without first having to drill or jet out the cored soil which would exist in an open-ended conductor 16. This in and of itself will reduce the time and expense normally required to achieve a working or producing platform.

What is claimed as invention is:

1. A method of installing a well conductor in a marine environment comprising the steps of:

a) sealing a well conductor with a watertight plug;

b) submerging said conductor from an elevated platform;

c) adding additional conductor lengths to said conductor as needed thereby forming a conductor string;

d) adjusting the buoyancy of said string to control the lowering of said string to the sea floor; and e) drilling through said plug after said conductor string has achieved the desired penetration depth.

2. The method as set forth in claim 1 wherein said conductor has a diameter-to-wall thickness ratio such that said conductor will achieve a desired degree of positive buoyancy.

3. The method as set forth in claim 2 wherein said ratio is approximately thirty to one (30:1), said ratio fluctuating more or less depending upon the amount of positive buoyancy and strength desired.

4. The method as set forth in claim 2 further comprising the step of selectively positioning said plug along said conductor string thereby also achieving the desired degree of buoyancy.

5. The method as set forth in claim 4 wherein said conductor and said conductor string are lowered by a platform crane under their own weight.

6. The method as set forth in claim 4 wherein said step of adjusting comprises the step of installing additional plugs in said conductor string as needed or selectively flooding said conductor string as needed.

7. The method as set forth in claim 6 further comprising the step of upending each said additional conductor length from a supply barge by a separate derrick crane and using said derrick crane to stab said additional length through said platform.

8. The method as set forth in claim 7 further comprising the step of installing two or more such conductor strings simultaneously.

9. The method as set forth in claim 8 further comprising the step of joining two or more said conductor lengths prior to upending.

10. A method of installing a well conductor in a marine environment comprising the steps of:

a) installing a plug in a conductor to make it watertight, said conductor having a specified diameter-to-wall thickness ratio depending upon the desired buoyancy and strength of said conductor;

b) upending said conductor and stabbing said conductor through an elevated platform;

c) lowering said conductor from said platform under its own weight;

d) adding additional conductor lengths to said conductor, thereby creating a conductor string, and successively lowering said conductor string from said platform under its own weight;

e) adjusting the buoyancy of said conductor string as needed until self-support is achieved; and, f) eliminating said plug from said conductor string.

11. The method as set forth in claim 10 wherein a derrick crane upends and stabs said conductor and wherein a separate crane lowers said conductor string.

12. The method as set forth in claim 11 wherein said step of adjusting comprises the step of installing additional plugs in said conductor string as needed or selectively flooding said conductor string as needed.

13. The method as set forth in claim 12 wherein two or more such conductor strings are installed simultaneously.

14. The method as set forth in claim 13 wherein two or more said conductor lengths ar joined together prior to upending.

15. The method as set forth in claim 14 wherein said ratio is approximately thirty to one (30:1), said ratio fluctuating more or less depending upon the amount of positive buoyancy and strength desired.

* * * * *